US012515089B2

(12) United States Patent
Zhang

(10) Patent No.: US 12,515,089 B2
(45) Date of Patent: Jan. 6, 2026

(54) DETACHABLE STRUCTURE AND MULTIFUNCTIONAL COMBINED FITNESS EQUIPMENT

(71) Applicant: Beijing Zhidong Sports Co., Ltd., Fengtai District Beijing (CN)

(72) Inventor: Hao Zhang, Gaobeidian (CN)

(73) Assignee: Beijing Zhidong Sports Co., Ltd., Beijing (CN)

( * ) Notice: Subject to any disclaimer, the term of this patent is extended or adjusted under 35 U.S.C. 154(b) by 194 days.

(21) Appl. No.: 18/206,152

(22) Filed: Jun. 6, 2023

(65) Prior Publication Data

US 2023/0330472 A1 Oct. 19, 2023

Related U.S. Application Data

(63) Continuation of application No. PCT/CN2022/116057, filed on Aug. 31, 2022.

(51) Int. Cl.
*A63B 21/072* (2006.01)

(52) U.S. Cl.
CPC ..... *A63B 21/0728* (2013.01); *A63B 21/0724* (2013.01); *A63B 21/0726* (2013.01); *A63B 2220/833* (2013.01)

(58) Field of Classification Search
CPC ..... A63B 5/20; A63B 21/072; A63B 21/0724; A63B 21/0726; A63B 21/0728; A63B 21/4035; A63B 2220/833
See application file for complete search history.

(56) References Cited

U.S. PATENT DOCUMENTS

| | | | | |
|---|---|---|---|---|
| 9,184,599 | B2 * | 11/2015 | Sun | F41A 19/58 |
| 10,188,904 | B2 * | 1/2019 | Tam | A63B 71/0036 |
| 11,517,784 | B2 * | 12/2022 | Heckman | A63B 21/0726 |
| 2017/0001061 | A1 | 1/2017 | Marjama et al. | |
| 2018/0353811 | A1 * | 12/2018 | Tam | A63B 1/00 |
| 2022/0339485 | A1 * | 10/2022 | Heckman | A63B 21/0726 |
| 2023/0173328 | A1 * | 6/2023 | Wu | A63B 21/075 482/107 |

FOREIGN PATENT DOCUMENTS

| | | |
|---|---|---|
| CN | 111035884 | 4/2020 |
| CN | 212789573 | 3/2021 |
| CN | 217472649 | 9/2022 |

* cited by examiner

*Primary Examiner* — Joshua Lee
(74) *Attorney, Agent, or Firm* — Bay State IP, LLC

(57) ABSTRACT

The present disclosure provides a detachable structure and multifunctional combined fitness equipment. The detachable structure comprises an inserting part and a matching part. A plug-in hole is formed in the matching part. A rotating part is arranged in the matching part. The rotating part is rotationally connected with the matching part. A clamping groove is formed in the rotating part. The clamping groove and the plug-in hole are matched with the inserting part in shape. The inserting part penetrates through the plug-in hole to be inserted into the clamping groove to drive the rotating part to rotate in the matching part. An anti-shaking structure is also arranged between the inserting part and the matching part. The anti-shaking structure comprises a chute arranged on the matching part and an inclined plane which is arranged on the inserting part and corresponding to the chute. The chute is matched with the inclined plane.

10 Claims, 13 Drawing Sheets

DETACHABLE STRUCTURE AND MULTIFUNCTIONAL COMBINED FITNESS EQUIPMENT

CROSS REFERENCE TO RELATED APPLICATION

This application is a continuation of the International Application No. PCT/CN2022/116057 which in turn claims the benefit and priority of Chinese Patent Application No. 202122519824.8 filed with the China National Intellectual Property Administration on Oct. 19, 2021, the disclosure of which is incorporated by reference herein in its entirety as part of the present application.

TECHNICAL FIELD

The present disclosure relates to the technical field of fitness equipment, in particular to a detachable structure and multifunctional combined fitness equipment.

BACKGROUND

With the development of society, people are often busy with work and study, or fight for careers and families, and often lack sleep. Particularly, the health problems of urban white-collar workers cannot be ignored. Therefore, many people choose to take exercise in gyms in order to keep physical fitness, but the gym cost is high, and many workers do not have so much time to go to the gym, so many people choose to take exercise at homes.

At present, the demands and pursuits of people for fitness are getting higher and higher, and ordinary fitness equipment cannot meet the needs for muscle fitness of the whole body. At present, most combined fitness equipment is heavy and inconvenient to use and complicated in conversion of functions, and rapid conversion and rapid adjustment of different needs of different people in the family cannot be realized. In addition, only a part of various assemblies of existing combined fitness equipment can be combined, but random combination cannot be achieved. Actually, a lot of accessories still need to be purchased, so that the cost is high, and a large area is occupied when the equipment is stored.

In addition, dumbbells, kettlebells and other small household fitness instruments are frequently used, but there are no corresponding matching assemblies in the market.

A plurality of assemblies of the existing combined fitness equipment cannot be repeatedly used, resulting in high cost when a plurality of products are purchased. Secondly, the dumbbell disc and dumbbell bar are of detachable structures, and there is a shaking problem at the joint.

SUMMARY

The present disclosure provides a detachable structure and multifunctional combined fitness equipment, that solves the technical problem that a plurality of assemblies of the combined fitness equipment of the prior art cannot be repeatedly used. Various technical effects generated by a preferred technical scheme in various technical schemes provided by the present disclosure are explained in detail as follow.

To achieve the above purpose, the present disclosure adopts the following technical scheme.

A detachable structure provided by the present disclosure includes an inserting part and a matching part. A plug-in hole is formed in the matching part. A rotating part is arranged in the matching part. The rotating part is rotationally connected with the matching part. A clamping groove is formed in the rotating part. The clamping groove and the plug-in hole are matched with the inserting part in shape and are of a rectangular structure. The inserting part penetrates through the plug-in hole to be inserted into the clamping groove to drive the rotating part to rotate in the matching part, so that the inserting part and the plug-in hole are arranged in a staggered mode.

An anti-shaking structure is also arranged between the inserting part and the matching part. The anti-shaking structure includes a chute arranged on the matching part and an inclined plane which is arranged on the inserting part and corresponding to the chute. The chute is matched with the inclined plane.

As further improvement of the present disclosure, the matching part includes a base body and a cover body. The base body is covered with the cover body. The plug-in hole is formed in the cover body.

A cavity is formed between the base body and the cover body. The rotating part is rotationally arranged in the cavity. The inclined planes are arranged on both sides of a top surface of the inserting part. The chute is formed in an inner wall of the cover body. After the inserting part penetrates through the plug-in hole to be inserted into the clamping groove, the rotating part is driven to rotate in the cavity. At this time, the inclined plane is closely matched with the chute.

As further improvement of the present disclosure, a positioning mechanism is also arranged in the matching part. The positioning mechanism includes a pressing part. A middle part of the pressing part is rotationally connected with the matching part. A first end of the pressing part extends to the outer side of the matching part. A first elastic piece is arranged between the first end of the pressing part and the matching part.

The rotating part is provided with ratchet teeth. Elastic force of the first elastic piece drives the first end of the pressing part to move out of the matching part, so that a second end of the pressing part abuts against the ratchet teeth.

When the first end of the pressing part is pressed, the first elastic piece is compressed, so that the second end of the pressing part is separated from the ratchet teeth.

As further improvement of the present disclosure, a limited post is arranged on the base body. An annular groove is formed in the rotating part. The limited post is matched with the annular groove.

As further improvement of the present disclosure, a rotating boss is arranged on the base body. A rotating groove is formed in the bottom of the rotating part. The rotating boss is matched with the rotating groove so that the rotating part can rotate in the cavity. The clamping groove is arranged on the top of the rotating part.

The rotating part is provided with a gear disc. The ratchet teeth are arranged on the gear disc. The gear disc is of a semi-arc structure and arranged on circumference of the rotating part. A limiting part is arranged on the cover body extending to the cavity. After the base body is covered with the cover body, the limiting part and the gear disc are on a same plane. When the rotating part rotates forward and backward, both ends of the gear disc can abut against the limiting part. The limiting part can limit a rotating interval of the gear disc.

Multifunctional combined fitness equipment includes a kettlebell body, dumbbell discs and the detachable structure.

The inserting parts are arranged on both sides of the kettlebell body. The matching part is arranged on one side of the dumbbell disc.

The inserting part is arranged on the other side of the dumbbell disc. The two adjacent dumbbell discs can be connected with the matching part through the inserting part.

As further improvement of the present disclosure, the multifunctional combined fitness equipment also includes a skipping rope structure. The skipping rope structure includes a skipping rope body and a skipping rope handle. The inserting parts are arranged at both ends of the skipping rope handle.

An outer cylinder and a fixed column are arranged in the skipping rope handle. The outer cylinder is rotationally arranged in the skipping rope handle through a first bearing. A second elastic piece is arranged in the outer cylinder. A first end of the fixed column penetrates into the outer cylinder and abuts against the second elastic piece. The fixed column is in transmission connection with the outer cylinder.

A middle part of the fixed column is fixedly provided with a second bearing. A rope threading hole is formed in a second end of the fixed column. The skipping rope body is fixed on the rope threading hole. Elastic force of the second elastic piece drives the second end of the fixed column to penetrate through the inserting part to the outer side of the skipping rope handle. When the fixed column is pressed, the second elastic piece can be compressed so that the second end of the fixed column can enter the skipping rope handle.

As further improvement of the present disclosure, the multifunctional combined fitness equipment also includes an intelligent handle. The intelligent handle includes a handle body and connectors connected to both ends of the handle body. A first end of the connector is provided with the inserting part. A six-axis force sensor is arranged on a second end of the connector inside the handle body. A circuit board and a six-axis sensor are arranged in the middle part of the handle body.

As further improvement of the present disclosure, the multifunctional combined fitness equipment also includes a dumbbell bar and a barbell bar. The inserting parts are arranged at both ends of the dumbbell bar and the barbell bar.

A plurality of dumbbell discs are provided, and the weights of the dumbbell discs are the same or different.

As further improvement of the present disclosure, the dumbbell disc includes a big dumbbell disc and a small dumbbell disc. A boss is arranged on the big dumbbell disc on one side of the matching part. A concave table corresponding to the boss is arranged on the big dumbbell disc on one side of the inserting part. The boss is matched with the concave table.

The detachable structure and the multifunctional combined fitness equipment have the following beneficial effects. The detachable structure includes an inserting part and a matching part. The inserting part can be inserted into the matching part through the plug-in hole in the matching part. The rotating part is arranged in the matching part. The rotating part is rotationally connected with the matching part. The clamping groove is formed in the rotating part. After the inserting part is inserted into the clamping groove, the rotating part is driven to rotate, so that the inserting part and the plug-in hole are arranged in a staggered mode. Because the inserting part, the clamping groove and the plug-in hole are all of rectangular structures, after the inserting part and the plug-in hole are arranged in a staggered mode, the inserting part is connected with the matching part. When the inserting part and the plug-in hole return to initial positions or rotate by 180 degrees, the inserting part is separated from the matching part, thus realizing detachable connection between the inserting part and the matching part.

An anti-shaking structure is also arranged between the inserting part and the matching part. The anti-shaking structure includes a chute arranged on the matching part and an inclined plane which is arranged on the inserting part and corresponding to the chute. The chute is matched with the inclined plane. When the inserting part is rotated, the chute and the inclined plane can be closely matched with each other, so that the problem of shaking between the inserting part and the matching part due to a gap between the inserting part and an inner wall of the matching part due to plane matching can be effectively avoided, and the problem of shaking at the joint of the dumbbell bar and the dumbbell disc is solved.

BRIEF DESCRIPTION OF THE DRAWINGS

In order to illustrate the technical scheme in the embodiment of this disclosure or in the prior art more clearly, the attached figures needing to be used in the embodiment or in the description in the prior art are simply described. Apparently, the embodiments in the following description are merely a part rather than all of the embodiments of the disclosure. For any person skilled in the art, under the premise of without contributing creative labor, other attached figures further can be obtained according to these attached figures.

Figure 1:
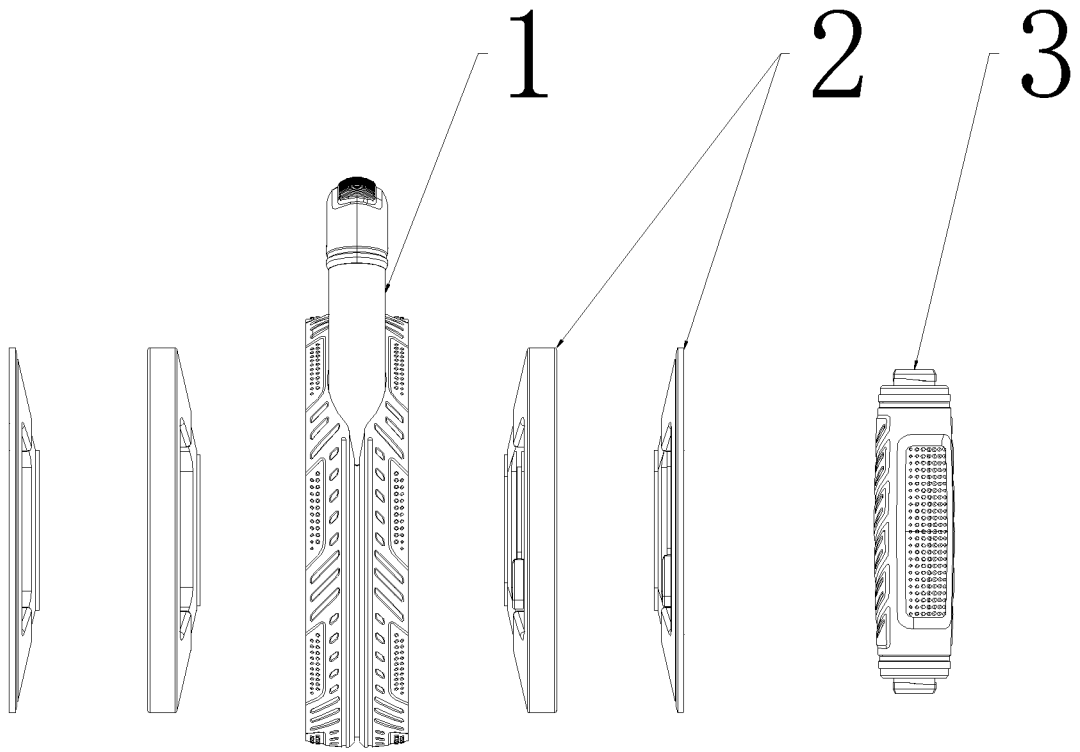
FIG. 1 is a structural schematic diagram of the present disclosure.

Reference signs: 1, kettlebell body; 2, dumbbell disc; 3, dumbbell bar; 5, inserting part; 6, matching part; 7, base body; 8, cover body; 9, rotating part; 10, skipping rope structure; 11, skipping rope handle; 12, intelligent handle; 13, barbell bar;

21, big dumbbell disc; 22, small dumbbell disc; 23, boss; 24, concave table; 51, inclined plane; 71, rotating boss; 72, pressing part; 73, first elastic piece; 74, limited post; 81, plug-in hole; 82, limiting part; 83, chute; 91, rotating groove; 92, clamping groove; 93, gear disc; 94, annular groove;

111, outer cylinder; 112, fixed column; 113, first bearing; 114, second elastic piece; 115, second bearing; 116, rope threading hole; 121, handle body; 122, connector; 123, six-axis force sensor; 124, circuit board; and 125, six-axis sensor.

DETAILED DESCRIPTION OF THE EMBODIMENTS

The contents of the present disclosure and the differences between the present disclosure and the prior art can be understood by referring to the attached figures FIG. 1 to FIG. 12 and the text. The technical schemes (including preferred technical schemes) of the present disclosure are further described in detail by means of the attached figures and a way of listing some optional embodiments of the present disclosure. It should be noted that any technical features and technical schemes in the embodiment are one or more of various optional technical features or optional technical schemes. In order to describe concisely, it is impossible to exhaust all alternative technical features and alternative technical schemes of the present disclosure in this document, and it is inconvenient for every technical feature to be emphasized as one of various optional implementations. Therefore, those skilled in the art should know that any technical means provided by the present disclosure can be replaced or any two or more technical means or technical features provided by the present disclosure can be combined with each other to obtain a new technical scheme. Any technical features and technical schemes in the embodiment do not limit the protection scope of the present disclosure. The protection scope of the present disclosure should include any alternative technical schemes that can be thought of by those skilled in the art without creative labor and new technical schemes obtained by combining any two or more technical means or technical features provided by the present disclosure.

In the description of the present disclosure, it needs to be illustrated that, except as otherwise noted, the meaning of "a plurality of" is two or more than two; and the indicative direction or position relations of the terms such as "upper", "lower", "left", "right", "inside", "outside", "front end", "rear end", "head" and "tail" are direction or position relations illustrated based on the accompanying diagrams, just for facilitating the description of the present disclosure and simplifying the description, but not for indicating or hinting that the indicated device or element must be in a specific direction and is constructed and operated in the specific direction, the terms cannot be understood as the restriction of the present disclosure. Moreover, the terms such as "first", "second", and "third" are just used for distinguishing the description, but cannot be understood to indicate or hint relative importance.

In the description of the present disclosure, it further needs to be illustrated that, except as otherwise noted, the terms such as "mount", "link" and "connect" should be generally understood. For example, the components can be fixedly connected, and also can be detachably connected or integrally connected; the components can be mechanically connected, and also can be electrically connected; and the components can be directly connected, and also can be indirectly connected through an intermediate. For those skilled in the art, the specific meanings of the terms in the present disclosure can be visually understood according to specific conditions.

The present disclosure provides a detachable structure and multifunctional combined fitness equipment, so that assemblies can be repeatedly used, and the purchase cost can be reduced.

The technical schemes provided by the present disclosure are described in detail with reference to FIG. 1 to FIG. 19.

The present disclosure provides a detachable structure, including an inserting part and a matching part. A plug-in hole is formed in the matching part. A rotating part is arranged in the matching part. The rotating part is rotationally connected with the matching part. A clamping groove is formed in the rotating part. The clamping groove and the plug-in hole are matched with the inserting part in shape and are of a rectangular structure. The inserting part penetrates through the plug-in hole to be inserted into the clamping groove to drive the rotating part to rotate in the matching part, so that the inserting part and the plug-in hole are arranged in a staggered mode.

An anti-shaking structure is also arranged between the inserting part and the matching part. The anti-shaking structure includes a chute arranged on the matching part and an inclined plane which is arranged on the inserting part and corresponding to the chute. The chute is matched with the inclined plane.

The detachable structure provided by the disclosure includes an inserting part and a matching part. The inserting part can be inserted into the matching part through the plug-in hole in the matching part. The rotating part is arranged in the matching part. The rotating part is rotationally connected with the matching part. The clamping groove is formed in the rotating part. After the inserting part is inserted into the clamping groove, the rotating part is driven to rotate, so that the inserting part and the plug-in hole are arranged in a staggered mode. Because the inserting part, the clamping groove and the plug-in hole are all of rectangular structures, after the inserting part and the plug-in hole are arranged in a staggered mode, the inserting part is connected with the matching part. When the inserting part and the plug-in hole return to initial positions or rotate by 180 degrees, the inserting part is separated from the matching part, thus realizing detachable connection between the inserting part and the matching part. An anti-shaking structure is also arranged between the inserting part and the matching part. The anti-shaking structure includes a chute arranged on the matching part and an inclined plane which is arranged on the inserting part and corresponding to the chute. The chute is matched with the inclined plane. When the inserting part is rotated, the chute and the inclined plane can be closely matched with each other, so that the problem of shaking between the inserting part and the matching part due to a gap between the inserting part and an inner wall of the matching part due to plane matching can be effectively avoided, and the problem of shaking at the joint of the dumbbell bar and the dumbbell disc is solved.

It should be noted here that the clamping groove, the plug-in hole and the inserting part can also be oval, triangular, parallelogram or other irregular figures.

As further improvement of the present disclosure, the matching part includes a base body and a cover body. The base body is covered with the cover body. The plug-in hole is formed in the cover body.

A cavity is formed between the base body and the cover body. The rotating part is rotationally arranged in the cavity. The inclined planes are arranged on both sides of a top surface of the inserting part. The chute is formed in an inner wall of the cover body. After the inserting part penetrates through the plug-in hole to be inserted into the clamping groove, the rotating part is driven to rotate in the cavity. At this time, the inclined plane is closely matched with the chute.

In the further improvement, the rotating part is rotationally arranged in the cavity between the base body and the cover body. Through the chute formed in the cover body, the inclined plane is arranged on the inserting part, and the chute is matched with the inclined plane. When the inserting part is rotated, the chute and the oblique plane can be closely matched with each other, so that the problem of shaking between the inserting part and the matching part due to the gap between the inserting part and the inner wall of the matching part due to plane matching can be effectively avoided.

As further improvement of the present disclosure, a positioning mechanism is also arranged in the matching part. The positioning mechanism includes a pressing part. A middle part of the pressing part is rotationally connected with the matching part. A first end of the pressing part extends to the outer side of the matching part. A first elastic piece is arranged between the first end of the pressing part and the matching part.

The rotating part is provided with ratchet teeth. Elastic force of the first elastic piece drives the first end of the pressing part to move out of the matching part, so that a second end of the pressing part abuts against the ratchet teeth.

When the first end of the pressing part is pressed, the first elastic piece is compressed, so that the second end of the pressing part is separated from the ratchet teeth.

In the further improvement, the positioning mechanism is also arranged in the matching part. The positioning mechanism consists of the pressing part, a spring and a gear disc. The pressing part is rotationally connected with the matching part. The spring is connected between the first end of the pressing part and the matching part. The rotating part is provided with the ratchet teeth. Elastic force of the spring can drive the first end of the pressing part to move, so that the second end of the pressing part abuts against the ratchet teeth on the rotating part. When the rotating part rotates until the pressing part abuts against the ratchet teeth, the pressing part and the rotating part can be locked, thus realizing positioning of the rotating part and the matching part. By pressing the first end of the pressing part, the spring is compressed, and the second end of the pressing part is separated from the ratchet teeth, so that the pressing part and the rotating part can be loosened.

As further improvement of the present disclosure, a limited post is arranged on the base body. An annular groove is formed in the rotating part. The limited post is matched with the annular groove.

In the further improvement, the limited post is matched with the annular groove, so that relative rotation and limitation between the rotating part and the base body are realized.

As further improvement of the present disclosure, a rotating boss is arranged on the base body. A rotating groove is formed in the bottom of the rotating part. The rotating boss is matched with the rotating groove so that the rotating part can rotate in the cavity. The clamping groove is arranged on the top of the rotating part.

The rotating part is provided with a gear disc. The ratchet teeth are arranged on the gear disc. The gear disc is of a semi-arc structure and arranged on circumference of the rotating part. A limiting part is arranged on the cover body extending to the cavity. After the base body is covered with the cover body, the limiting part and the gear disc are on a same plane. When the rotating part rotates forward and backward, both ends of the gear disc can abut against the limiting part. The limiting part can limit a rotating interval of the gear disc.

In the further improvement, the rotating part is rotationally connected with the base body through the rotating boss and the rotating groove. The gear disc is arranged on the rotating part. The ratchet teeth are arranged on the gear disc. The second end of the pressing part is located on one side of the gear disc. The elastic force of the spring can drive the first end of the pressing part to move, so that the second end of the pressing part abuts against the ratchet teeth on the gear disc. When the rotating part rotates until the pressing part abuts against the ratchet teeth, the pressing part and the gear disc can be locked, so that the positioning of the rotating part and the matching part is realized. By pressing the first end of the pressing part, the spring is compressed, and the second end of the pressing part is separated from the gear disc, so that the pressing part and the gear disc can be loosened.

The gear disc is arranged to be of the semi-arc structure, and the limiting part is arranged on the cover body. When the gear disc rotates with the rotating part, the gear disc can abut against the limiting part, thus limiting the rotating interval of the rotating part. The inserting part can be separated from the matching part only when the rotating part rotates to an initial position.

Multifunctional combined fitness equipment includes a kettlebell body, dumbbell discs and the detachable structure.

The inserting parts are arranged on both sides of the kettlebell body. The matching part is arranged on one side of the dumbbell disc.

The inserting part is arranged on the other side of the dumbbell disc. The two adjacent dumbbell discs can be connected with the matching part through the inserting part.

The multifunctional combined fitness equipment provided by the present disclosure includes a kettlebell body and dumbbell discs. The kettlebell body and the dumbbell disc can be detachably connected through the detachable structure, so that the weight of the kettlebell body can be adjusted, and the storage space can be greatly saved during daily storage.

As further improvement of the present disclosure, the multifunctional combined fitness equipment also includes a skipping rope structure. The skipping rope structure includes a skipping rope body and a skipping rope handle. The inserting parts are arranged at both ends of the skipping rope handle.

An outer cylinder and a fixed column are arranged in the skipping rope handle. The outer cylinder is rotationally arranged in the skipping rope handle through a first bearing. A second elastic piece is arranged in the outer cylinder. A first end of the fixed column penetrates into the outer cylinder and abuts against the second elastic piece. The fixed column is in transmission connection with the outer cylinder.

A middle part of the fixed column is fixedly provided with a second bearing. A rope threading hole is formed in a second end of the fixed column. The skipping rope body is fixed on the rope threading hole. Elastic force of the second elastic piece drives the second end of the fixed column to penetrate through the inserting part to the outer side of the skipping rope handle. When the fixed column is pressed, the second elastic piece can be compressed so that the second end of the fixed column can enter the skipping rope handle.

The multifunctional combined fitness equipment provided by the equipment also includes a skipping rope structure. The skipping rope structure includes a skipping rope body and a skipping rope handle. Firstly, both ends of the skipping rope handle are provided with the inserting parts, and the skipping rope handle can be detachably connected with the dumbbell disc and combined with the dumbbell disc to form a dumbbell for use. Secondly, the skipping rope handle is internally provided with the outer cylinder and the fixed column. The rope threading hole is formed in the fixed column for connecting the fixed column with the rope skipping body, so that the skipping rope handle can be combined to be used as a skipping rope, thereby realizing the multifunctional use of the skipping rope handle. The skipping rope handle is of the above structure, so that when the fixed column is connected with the dumbbell disc, automatic storage in the skipping rope handle can be realized by pressing. In addition, a sensor is arranged on the outer cylinder, and a control panel is arranged in the skipping rope handle, so that the skipping rope handle is intelligent and meets the needs of rope skipping counting.

As further improvement of the present disclosure, the multifunctional combined fitness equipment also includes an intelligent handle. The intelligent handle includes a handle body and connectors connected to both ends of the handle body. A first end of the connector is provided with the inserting part. A six-axis force sensor is arranged on a second end of the connector inside the handle body. A circuit board and a six-axis sensor are arranged in the middle part of the handle body.

The multifunctional combined fitness equipment provided by the present disclosure further includes an intelligent handle. Six-axis force sensors are arranged at both ends in the intelligent handle to monitor pulling force values at both ends of the intelligent handle. A circuit board and a six-axis sensor are arranged in the intelligent handle to record movement tracks and speed.

As further improvement of the present disclosure, the multifunctional combined fitness equipment also includes a dumbbell bar and a barbell bar. The inserting parts are arranged at both ends of the dumbbell bar and the barbell bar.

A plurality of dumbbell discs are provided, and the weights of the dumbbell discs are the same or different.

As further improvement of the present disclosure, the dumbbell disc includes a big dumbbell disc and a small dumbbell disc. A boss is arranged on the big dumbbell disc on one side of the matching part. A concave table corresponding to the boss is arranged on the big dumbbell disc on one side of the inserting part. The boss is matched with the concave table.

In the further improvement, a dumbbell bar and dumbbell discs can form a dumbbell, and a barbell bar and dumbbell discs can form a barbell, so that the use needs of the dumbbell and barbell are met, and the weights can be randomly combined to meet the needs of different users. In addition, the dumbbell disc includes a big dumbbell disc and a small dumbbell disc. A boss is arranged on the big dumbbell disc on one side of the matching part. A concave table corresponding to the boss is arranged on the big dumbbell disc on one side of the inserting part. The boss is matched with the concave table, so that the big dumbbell disc can suspend the big dumbbell disc and the small dumbbell disc, but the small dumbbell disc can only suspend the small dumbbell disc, upside-down hanging is prevented, and uniform weight distribution is avoided.

Embodiment I

Figure 2:
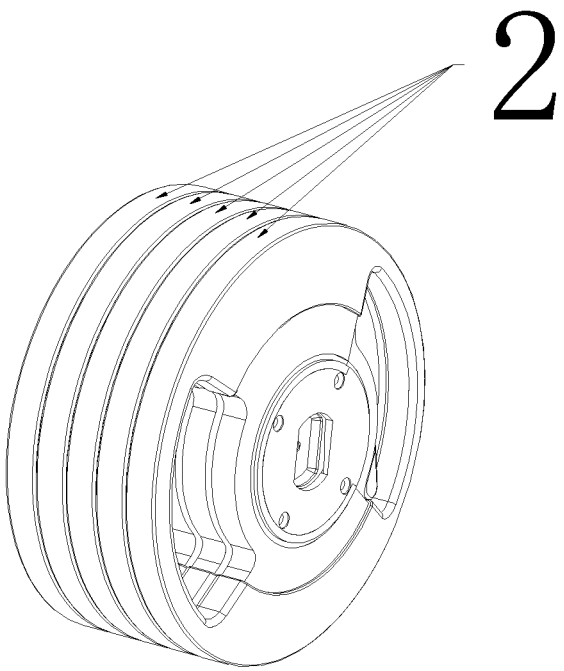
FIG. 2 is a combined structural schematic diagram of a plurality of dumbbell discs in the present disclosure.
Figure 3:
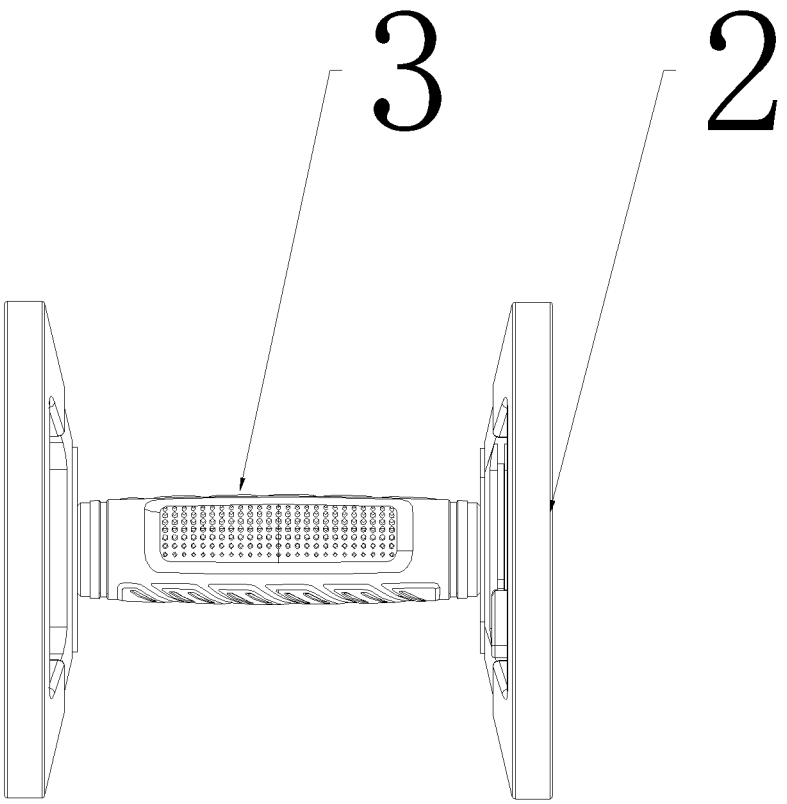
FIG. 3 is a combined structural schematic diagram of a dumbbell bar and dumbbell discs in the present disclosure.
Figure 4:
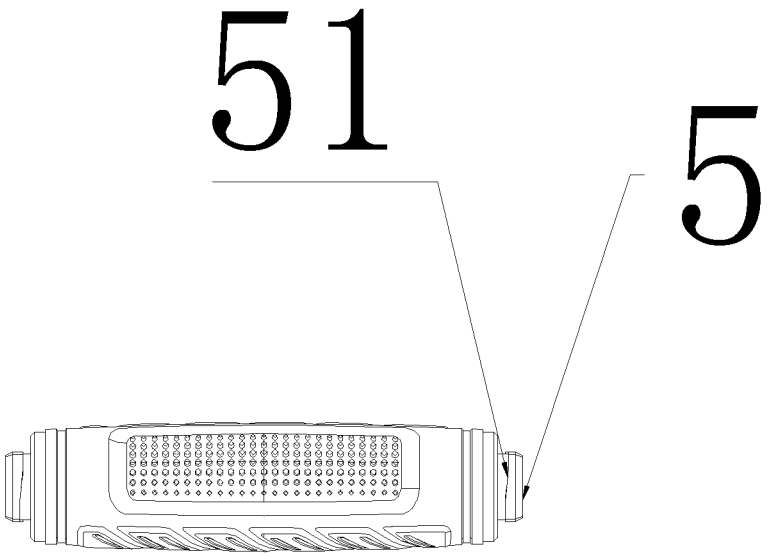
FIG. 4 is a structural schematic diagram of a dumbbell bar in the present disclosure.
Figure 5:
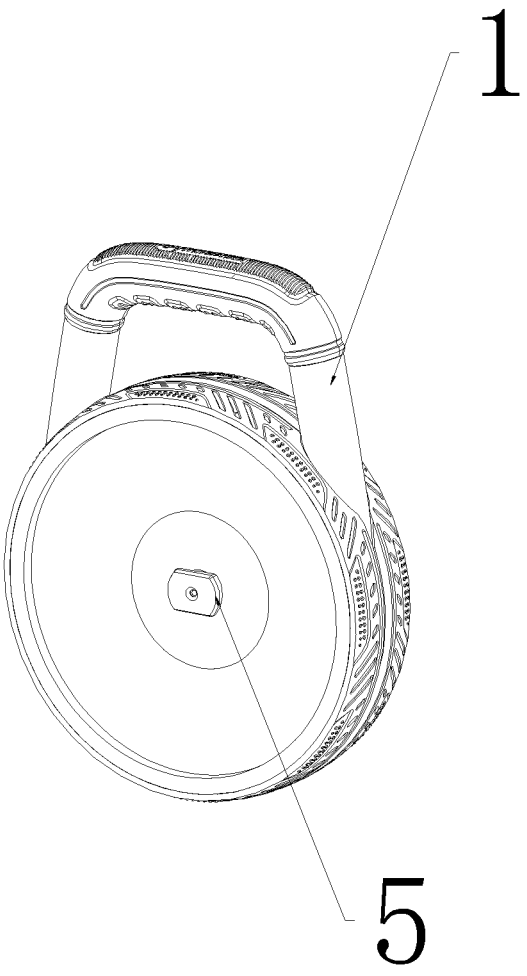
FIG. 5 is a structural schematic diagram of a kettlebell body in the present disclosure.
Figure 6:
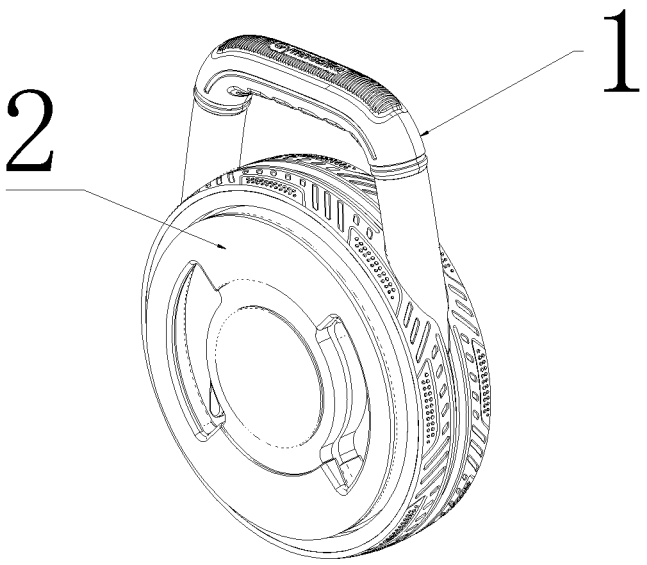
FIG. 6 is a combined structural schematic diagram of a kettlebell body and dumbbell discs in the present disclosure.
Figure 7:
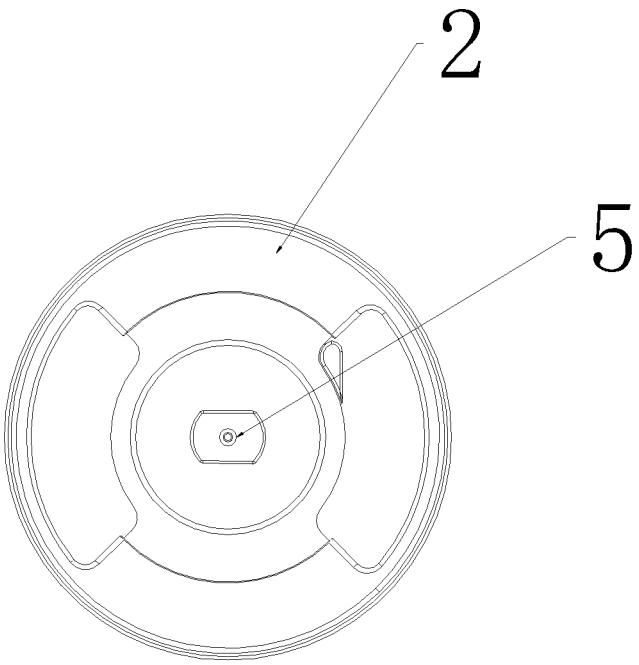
FIG. 7 is a structural schematic diagram of a dumbbell disc in the present disclosure.
Figure 8:
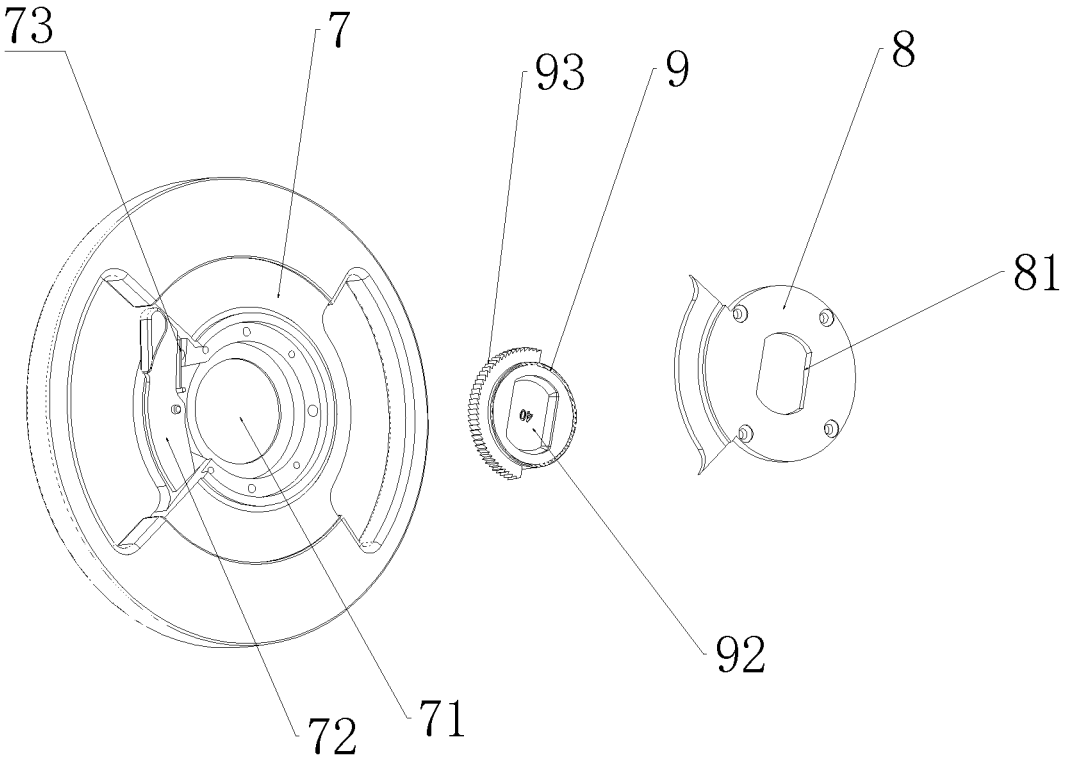
FIG. 8 is an explosive structural schematic diagram of a dumbbell disc in the present disclosure.
Figure 9:
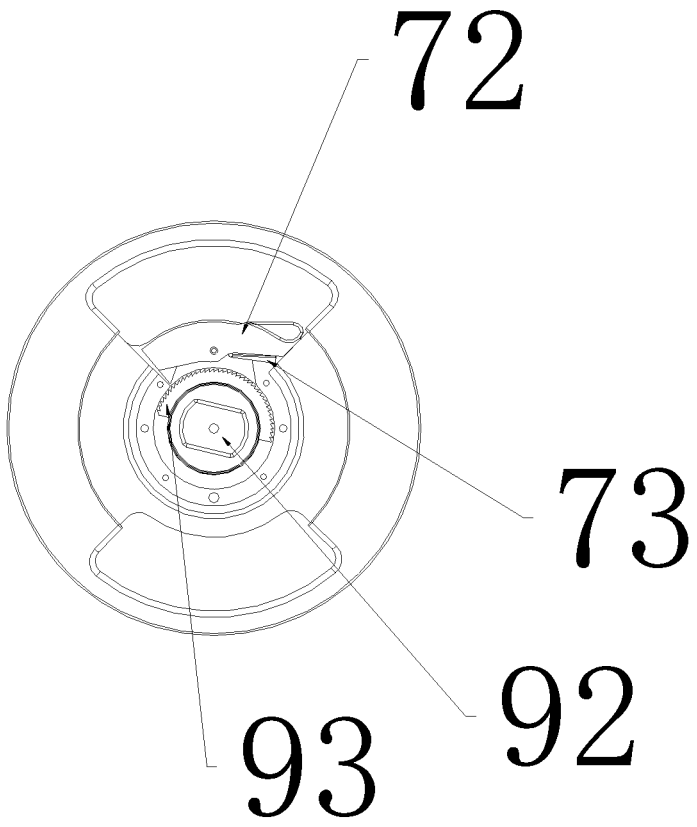
FIG. 9 is a first partial structural schematic diagram of a dumbbell disc in the present disclosure.
Figure 10:
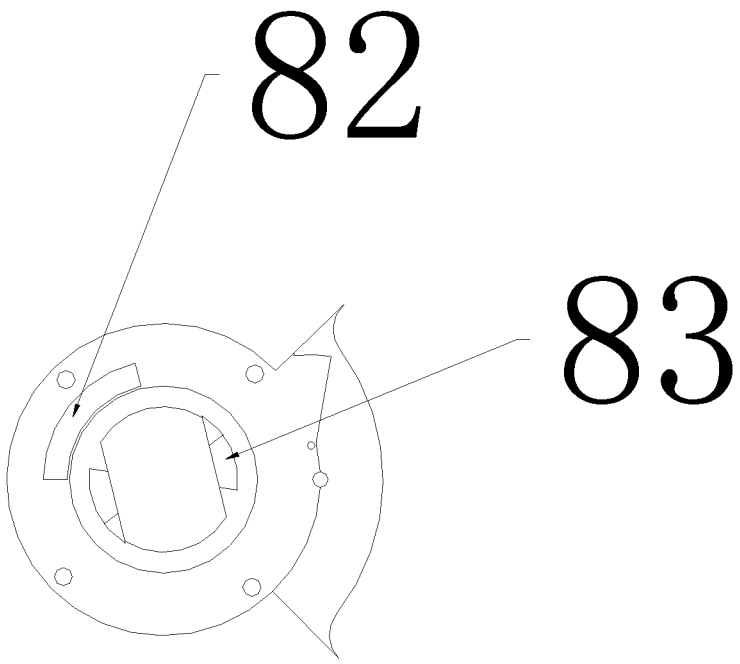
FIG. 10 is a structural schematic diagram of a cover body in the present disclosure.
Figure 11:
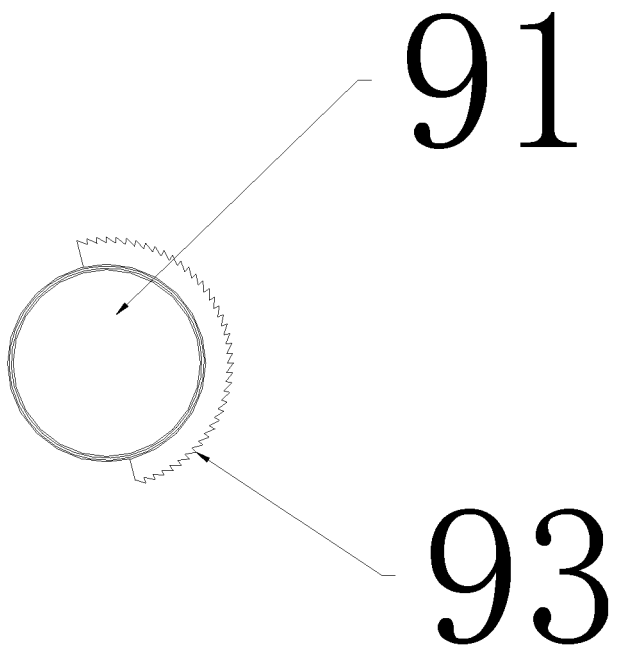
FIG. 11 is a structural schematic diagram of a rotating part in the present disclosure.
Figure 12:
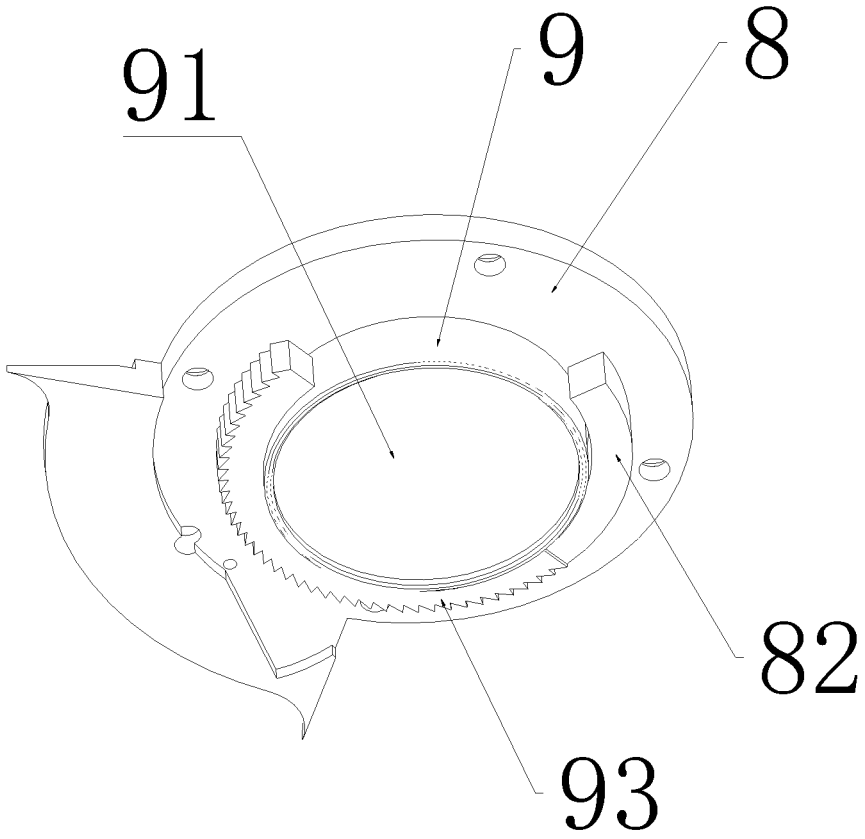
FIG. 12 is a second partial structural schematic diagram of the present disclosure.
Figure 13:
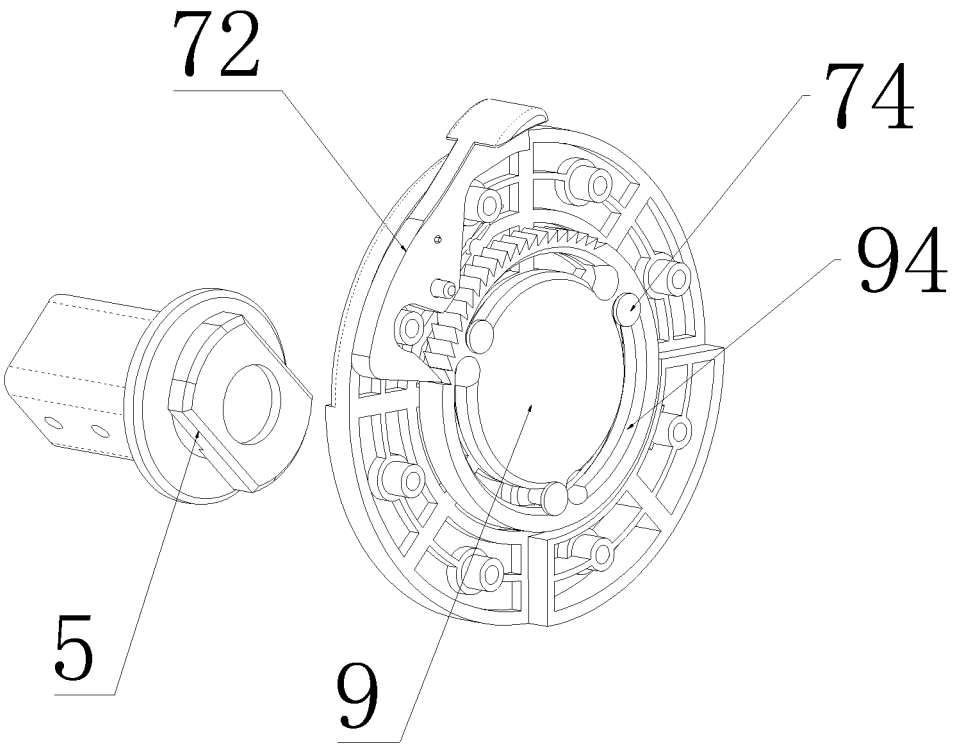
FIG. 13 is an internal structural schematic diagram of a dumbbell disc in a second embodiment of the present disclosure.
Figure 14:
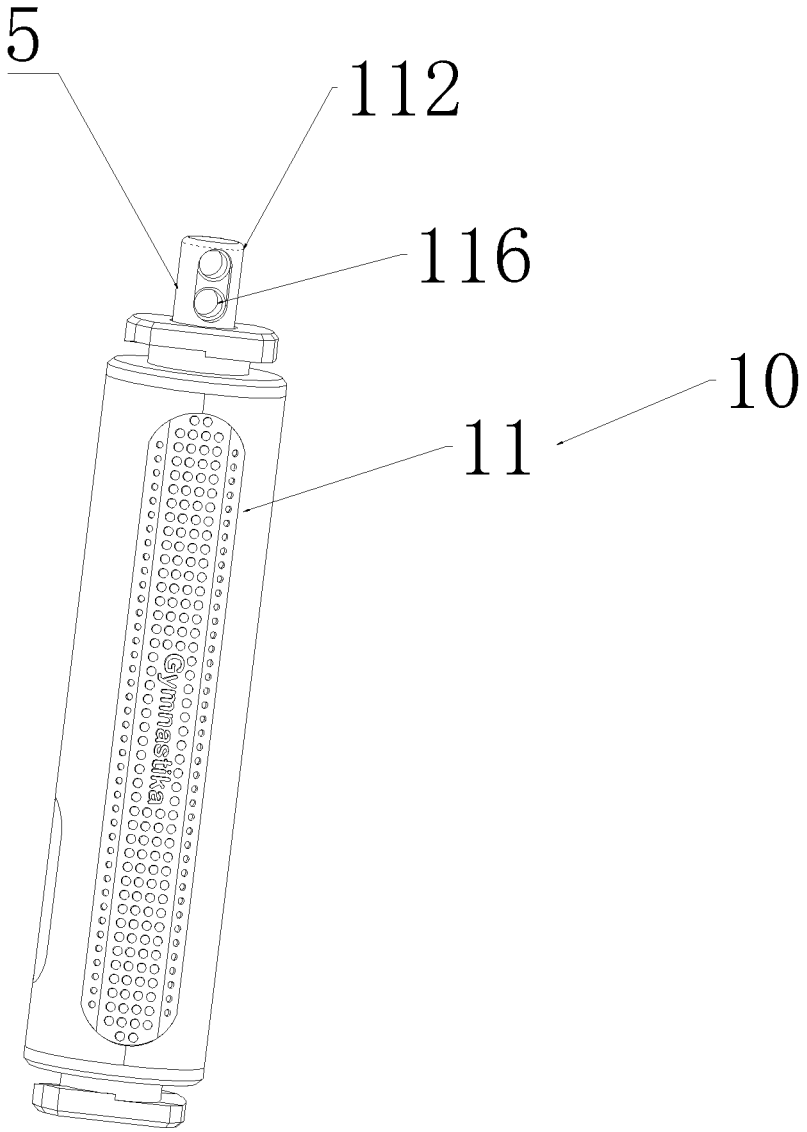
FIG. 14 is a structural schematic diagram of a skipping rope handle in a third embodiment of the present disclosure.
Figure 15:
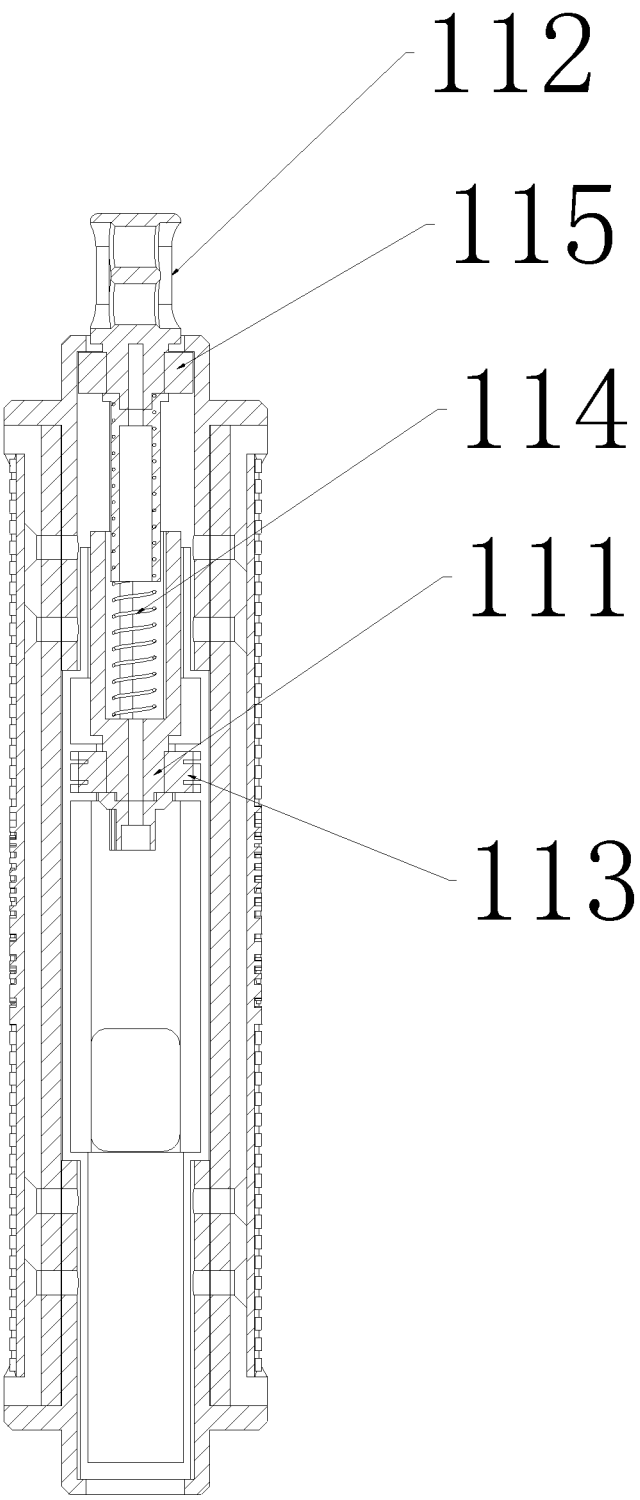
FIG. 15 is a structural schematic diagram of a skipping rope handle in a third embodiment of the present disclosure.
Figure 16:
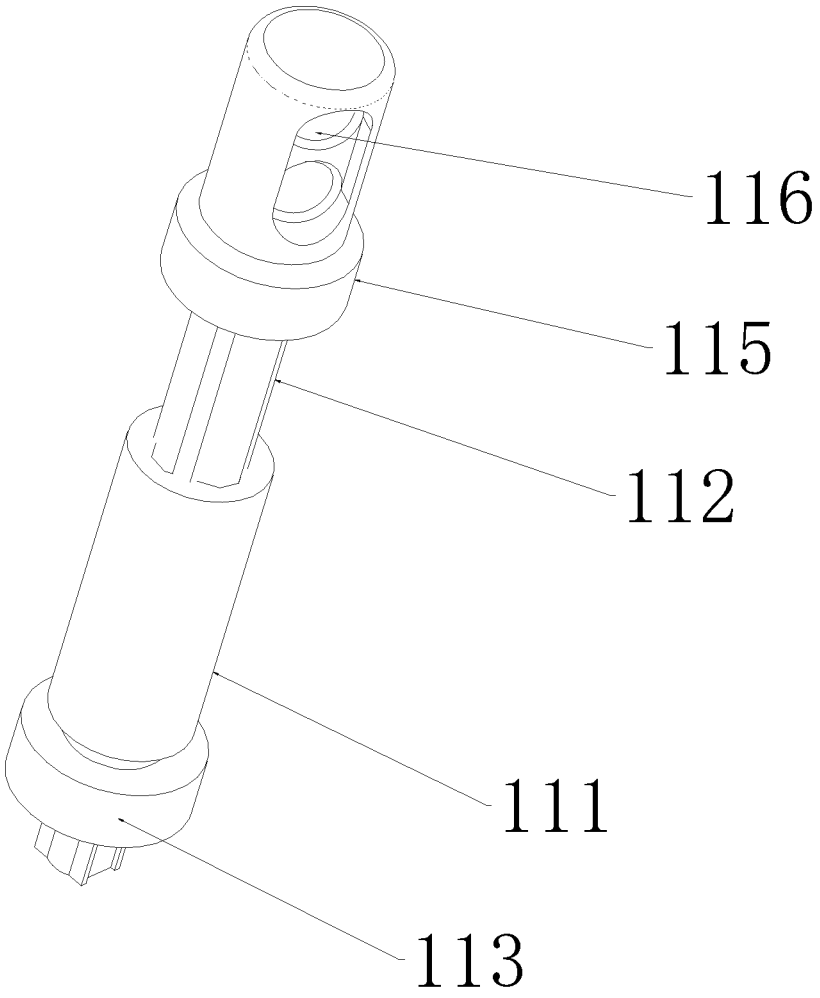
FIG. 16 is a partial structural schematic diagram of a skipping rope handle in a third embodiment of the present disclosure.
Figure 17:
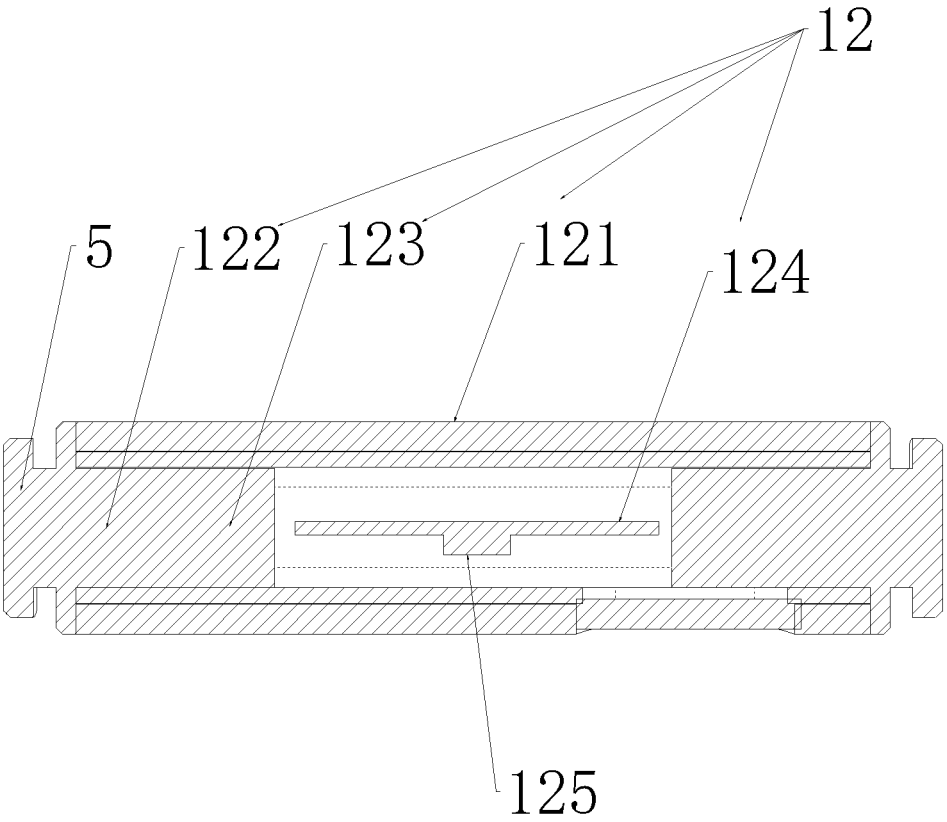
FIG. 17 is a partial structural schematic diagram of an intelligent handle in a fourth embodiment of the present disclosure.
Figure 18:
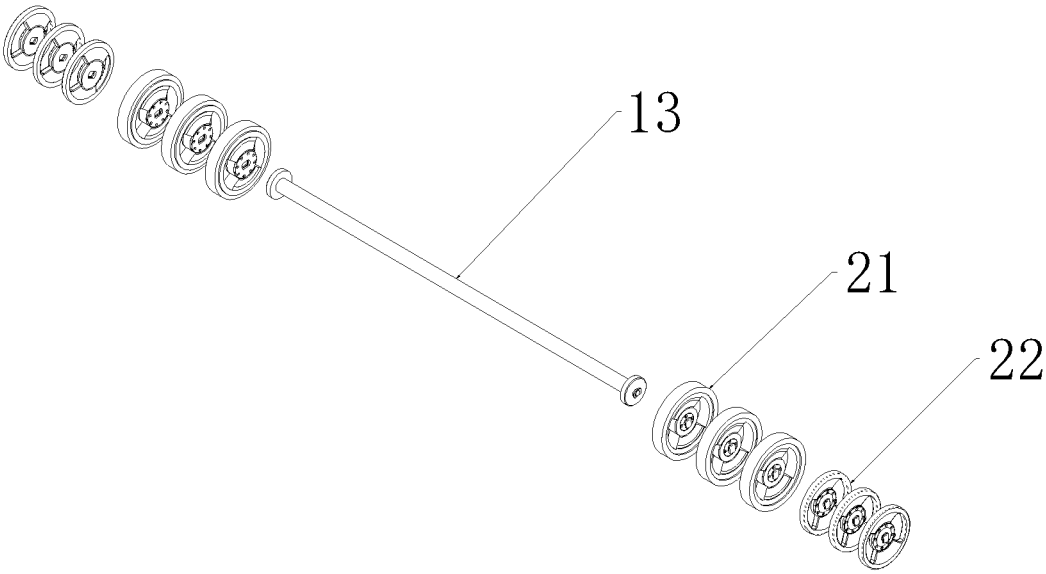
FIG. 18 is a structural schematic diagram of a barbell in a the fifth embodiment of the present disclosure.
Figure 19:
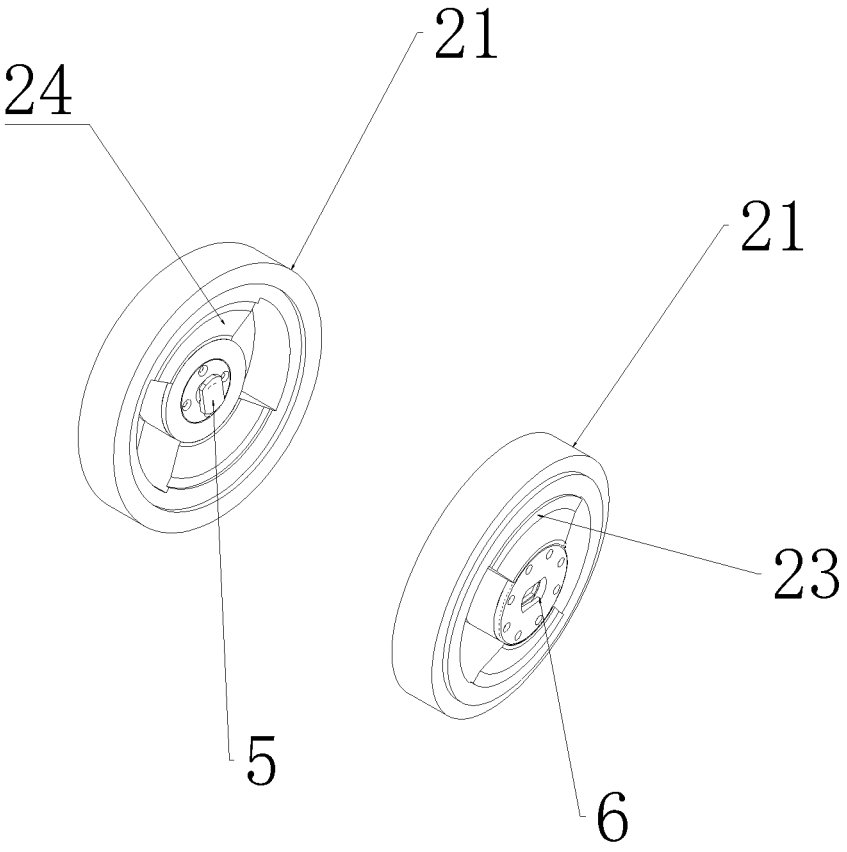
FIG. 19 is a structural schematic diagram of big dumbbell discs in a fifth embodiment of the present disclosure.

The multifunctional combined fitness equipment provided by the present disclosure, as shown in FIG. 1, includes a kettlebell body 1, dumbbell discs 2 and a dumbbell bar 3. As shown in FIG. 2, the two adjacent dumbbell discs 2 can be connected through the detachable structure and combined into an integral structure. As shown in FIG. 3 and FIG. 4, both ends of the dumbbell bar 3 and the dumbbell discs 2 can be connected through the detachable structure, and the dumbbell bar 3 and the dumbbell discs 2 can be combined into a dumbbell. As shown in FIG. 5 and FIG. 6, both sides of the kettlebell body 1 and the dumbbell discs 2 can be connected through the detachable structure, and the kettlebell body 1 and the dumbbell discs 2 can be randomly combined into kettlebells with different weights.

Specifically, the detachable structure includes an inserting part 5 and a matching part 6, and the inserting part 5 is detachably connected with the matching part 6.

In the embodiment, the inserting parts 5 are arranged on both sides of the kettlebell body 1, and the inserting parts 5 are also arranged on both sides of the dumbbell bar 3. The matching part 6 is arranged on one side of the dumbbell disc 2, and the inserting part 5 is arranged on the other side of the dumbbell disc 2. The inserting parts 5 on the two adjacent dumbbell discs 2 are detachably connected with the matching parts 6, so that a plurality of dumbbell discs 2 are randomly combined. The inserting parts 5 on both sides of the kettlebell body 1 are detachably connected with the matching parts 6 on the dumbbell discs 2, so that kettlebells with different weights are combined. The inserting parts 5 on both sides of the dumbbell bar 3 are detachably connected with the matching parts 6 on the dumbbell discs 2, so that dumbbells with different weights are combined.

More specifically, the structure of the dumbbell disc 2 is shown in FIG. 7 to FIG. 12. The inserting part 5 is arranged on one side of the dumbbell disc 2, and the matching part 6 is arranged on the other side of the dumbbell disc 2. The inserting part 5 is of a rectangular structure. The matching part 6 includes a base body 7 and a cover body 8. The base body 7 is covered with the cover body 8. A cavity is formed between the base body 7 and the cover body 8. A plug-in hole 81 is formed in the cover body 8. The inserting part 5 can penetrate into the middle of the cover body 8 and the base body 7 from the plug-in hole 81.

A rotating part 9 is arranged between the cover body 8 and the base body 7. The rotating part 9 is rotationally arranged in the cavity. Specifically, a rotating boss 71 is arranged on the base body 7. A rotating groove 91 is formed in the bottom of the rotating part 9. The rotating boss 71 is matched with the rotating groove 91, so that the rotating part 9 can rotate in the cavity. A clamping groove 92 is formed in the top of the rotating part 9. The clamping groove 92 and the plug-in hole 81 are matched with the inserting part 5 in shape, and are of a rectangular structure.

The inserting part 5 penetrates through the plug-in hole 81 to be inserted into the clamping groove 92 to drive the rotating part 9 to rotate in the matching part, so that the inserting part 5 and the plug-in hole 81 are arranged in a staggered mode. Therefore, the inserting part 5 and the matching part 6 are locked. At this time, the inserting part 5 can be separated from the matching part 6 only when the inserting part 5 rotates until the same as the plug-in hole 81.

A positioning mechanism is also arranged between the cover body 8 and the base body 7. The positioning mechanism includes a pressing part 72. A middle part of the pressing part 72 is rotationally connected with the base body 7. A first end of the pressing part 72 extends to the outer side of the base body 7. An elastic piece 73 is arranged between the first end of the pressing part 72 and the base body 7.

The rotating part 9 is provided with a gear disc 93. Elastic force of the elastic piece 73 drives the first end of the pressing part 72 to move out of the base body 7, so that a second end of the pressing part 72 abuts against saw teeth of the gear disc 93.

When the first end of the pressing part 72 is pressed, the elastic piece 73 is compressed, so that the second end of the pressing part 72 is separated from the saw teeth of the gear disc 93.

Further, as shown in figures, the gear disc 93 is of a semi-arc structure and arranged on circumference of the rotating part 9. A limiting part 82 is arranged on the cover body 8 extending to the cavity. After the base body 7 is covered with the cover body 8, the limiting part 82 and the gear disc 93 are on a same plane. When the rotating part 9 rotates forward and backward, both ends of the gear disc 93 can abut against the limiting part 82. The limiting part 82 can limit a rotating interval of the gear disc 93.

Further, a chute 83 is formed in an inner wall of the cover body 8. Inclined planes 51 matched with the chutes 83 are arranged on both sides of a top surface of the inserting part 5. After the inserting part 5 penetrates through the plug-in hole 81 to be inserted into the clamping groove 92, the rotating part 9 is driven to rotate in the cavity. At this time, the inclined plane 51 of the inserting part 5 is closely matched with the chute 83.

Embodiment II

The difference between the second embodiment and the first embodiment lies in that three limited post 74 are arranged on the base body 7. Three annular grooves 94 are formed in the rotating part 9. The limited post 74 is matched with the annular groove 94. The ratchet teeth are arranged on an outer edge of the rotating part 9.

Embodiment III

The difference between the third embodiment and the first embodiment lies in that the multifunctional combined fitness equipment provided by the present disclosure also includes a skipping rope structure 10. The skipping rope structure includes a skipping rope body and a skipping rope handle 11. The inserting parts 5 are arranged at both ends of the skipping rope handle 11.

An outer cylinder 111 and a fixed column 112 are arranged in the skipping rope handle 11. The outer cylinder 111 is rotationally arranged in the skipping rope handle 11 through a first bearing 113. A second elastic piece 114 is arranged in the outer cylinder 111. A first end of the fixed column 112 penetrates into the outer cylinder 111 and abuts against the second elastic piece 114. The fixed column 112 is in transmission connection with the outer cylinder 111.

A middle part of the fixed column 112 is fixedly provided with a second bearing 115. A rope threading hole 116 is formed in a second end of the fixed column 112. The skipping rope body is fixed on the rope threading hole 116. Elastic force of the second elastic piece 114 drives the second end of the fixed column 112 to penetrate through the inserting part 5 to the outer side of the skipping rope handle 11. When the fixed column 112 is pressed, the second elastic piece 114 can be compressed so that the second end of the fixed column 112 can enter the skipping rope handle 11.

Specifically, the second end of the fixed column 112 is of a polygonal structure, and an inner wall of the outer cylinder 111 is of a polygonal structure matched with the second end of the fixed column 112.

Embodiment IV

The difference between the fourth embodiment and the third embodiment lies in that the multifunctional combined fitness equipment provided by the present disclosure also includes an intelligent handle 12. The intelligent handle 12 includes a handle body 121 and connectors 122 connected to both ends of the handle body 121. A first end of the connector 122 is provided with the inserting part 5. A six-axis force sensor 123 is arranged on a second end of the connector 122 inside the handle body 121. A circuit board 124 and a six-axis sensor 125 are arranged in the middle part of the handle body 121.

Embodiment V

The difference between the third embodiment and the first embodiment lies in that the multifunctional combined fitness equipment provided by the present disclosure also includes a barbell bar 13. The inserting parts 5 are arranged at both ends of the barbell bar 13.

The dumbbell disc 2 includes a big dumbbell disc 21 and a small dumbbell disc 22. A boss 23 is arranged on the big dumbbell disc 21 on one side of the matching part 6. A concave table 24 corresponding to the boss 23 is arranged on the big dumbbell disc 21 on one side of the inserting part 5. The boss 23 is matched with the concave table 24.

The foregoing descriptions are merely specific embodiments of the disclosure, but are not intended to limit the protection scope of the disclosure. Any variation or replacement readily figured out by a person skilled in the art within the technical scope disclosed in the disclosure shall fall within the protection scope of the disclosure. Therefore, the protection scope of this disclosure shall be subject to the protection scope of the claims.

What is claimed is:

1. A detachable structure, the detachable structure comprising:

an inserting part and a matching part, a plug-in hole formed in the matching part, a rotating part arranged in the matching part, the rotating part rotationally connected with the matching part, a clamping groove formed in the rotating part, the clamping groove and the plug-in hole matched with the inserting part in shape and are of a rectangular structure, and the inserting part penetrated through the plug-in hole to be inserted into the clamping groove to drive the rotating part to rotate in the matching part, so that the inserting part and the plug-in hole are arranged in a staggered mode; and an anti-shaking structure arranged between the inserting part and the matching part, the anti-shaking structure comprising:

a chute arranged on the matching part, and an inclined plane which is arranged on the inserting part and corresponds to the chute.

2. The detachable structure according to claim 1, wherein the matching part comprises:

a base body, and a cover body;

wherein the base body is covered with the cover body, and the plug-in hole is formed in the cover body;

wherein a cavity forms between the base body and the cover body, the rotating part is rotationally arranged in the cavity, the inclined plane is arranged on both sides of a top surface of the inserting part, and the chute is formed in an inner wall of the cover body, and wherein after the inserting part penetrates through the plug-in hole to be inserted into the clamping groove, the rotating part is driven to rotate in the cavity.

3. The detachable structure according to claim 2, wherein a positioning mechanism is also arranged in the matching part, wherein the positioning mechanism comprises:

a pressing part, a middle part of the pressing part rotationally connected with the matching part, a first end of the pressing part extending to an outer side of the matching part, and a first elastic piece arranged between the first end of the pressing part and the matching part;

wherein the rotating part is provided with ratchet teeth, and elastic force of the first elastic piece drives the first end of the pressing part to move out of the matching part, so that a second end of the pressing part abuts against the ratchet teeth; and wherein when the first end of the pressing part is pressed, the first elastic piece is compressed, so that the second end of the pressing part is separated from the ratchet teeth.

4. The detachable structure according to claim 3, wherein a limited post is arranged on the base body, an annular groove is formed in the rotating part, and the limited post is matched with the annular groove.

5. The detachable structure according to claim 3, wherein a rotating boss is arranged on the base body, a rotating groove is formed in a bottom of the rotating part, and the clamping groove is arranged on a top of the rotating part; and wherein the rotating part is provided with a gear disc, the ratchet teeth are arranged on the gear disc, the gear disc is of a semi-arc structure and arranged on a circumference of the rotating part, a limiting part is arranged on the cover body extending to the cavity, after the base body is covered with the cover body, the limiting part and the gear disc are on a same plane, when the rotating part rotates forward and backward, both ends of the gear disc can abut against the limiting part, and the limiting part can limit a rotating interval of the gear disc.

6. Multifunctional combined fitness equipment, the multifunctional combined fitness equipment further comprising:

a kettlebell body, two dumbbell discs, and the detachable structure according to claim 1, wherein the inserting part is arranged on both sides of the kettlebell body, and the matching part is arranged below one side of the dumbbell discs; and wherein the inserting part is arranged on an other side of the dumbbell discs, and the two dumbbell discs can be connected with the matching part through the inserting part.

7. The multifunctional combined fitness equipment according to claim 6, further comprising:

a skipping rope structure, wherein the skipping rope structure comprises:

a skipping rope body, a skipping rope handle, an inserting part arranged at both ends of the skipping rope handle;

an outer cylinder, and a fixed column arranged in the skipping rope handle;

wherein the outer cylinder is rotationally arranged in the skipping rope handle through a first bearing, a second elastic piece is arranged in the outer cylinder, a first end of the fixed column penetrates into the outer cylinder and abuts against the second elastic piece, and the fixed column is in transmission connection with the outer cylinder; and wherein a middle part of the fixed column is fixedly provided with a second bearing, wherein a rope threading hole is formed in a second end of the fixed column, the skipping rope body is fixed on the rope threading hole, elastic force of the second elastic piece drives the second end of the fixed column to penetrate through the inserting part to an outer side of the skipping rope handle, and when the fixed column is pressed, the second elastic piece can be compressed so that the second end of the fixed column can enter the skipping rope handle.

8. The multifunctional combined fitness equipment according to claim 6, also comprising an intelligent handle, wherein the intelligent handle comprises:

a handle body, connectors connected to both ends of the handle body, a six-axis force sensor arranged on a second end of a connector inside the handle body, a circuit board, and a six-axis sensor arranged in a middle part of the handle body.

9. The multifunctional combined fitness equipment according to claim 6, further comprising:

a dumbbell bar, and a barbell bar;

wherein the inserting part is arranged at both ends of the dumbbell bar and the barbell bar; and wherein the dumbbell discs are provided, and weights of the dumbbell discs are the same or different.

10. The multifunctional combined fitness equipment according to claim 9, wherein the dumbbell discs comprise:

a big dumbbell disc, and a small dumbbell disc;

wherein a boss is arranged on the big dumbbell disc on one side of the matching part arranged below the dumbbell discs.

* * * * *